United States Patent [19]

Schnöring et al.

[11] 4,378,425

[45] Mar. 29, 1983

[54] PROCESS FOR THE PRODUCTION OF DISPERSIONS AND PHOTOGRAPHIC MATERIALS

[75] Inventors: Hildegard Schnöring, Wuppertal; Karl-Wilhelm Schranz; Günther Koepke, both of Odenthal, all of Fed. Rep. of Germany

[73] Assignee: Agfa Gevaert Aktiengesellschaft, Leverkusen, Fed. Rep. of Germany

[21] Appl. No.: 292,234

[22] Filed: Aug. 12, 1981

[30] Foreign Application Priority Data

Aug. 20, 1980 [DE] Fed. Rep. of Germany ..... 3031404

[51] Int. Cl.[3] ..... G03C 1/40

[52] U.S. Cl. ..... 430/377; 430/449; 430/512; 430/546; 430/569; 430/607; 430/631

[58] Field of Search ..... 430/449, 377, 546, 642, 430/512, 607, 631

[56] References Cited

U.S. PATENT DOCUMENTS 3,676,142 7/1972 Carpentier et al. ..... 430/449
3,788,857 1/1974 Van Poucke et al. ..... 430/546
3,860,425 1/1975 Ono et al. ..... 430/139
4,003,748 1/1977 Langen et al. ..... 430/546

FOREIGN PATENT DOCUMENTS 636102 4/1950 United Kingdom .

*Primary Examiner*—J. Travis Brown
*Attorney, Agent, or Firm*—Connolly and Hutz

[57] ABSTRACT

The invention relates to a process for the production of photographic emulsates consisting of dispersions of water-immiscible or water-insoluble particles in aqueous binder solution, characterized in that the entire non-aqueous phase is initially introduced at a temperature above the liquefaction temperatures of the aqueous and non-aqueous phases, after which a relatively small volume of aqueous phase is emulsified continuously or in portions into the non-aqueous phase by known methods and then more aqueous phase is introduced while emulsification is continued in such a quantity that the viscosity of the emulsion passes through a maximum (indicating phase reversal into an emulsion of non-aqueous particles in aqueous dispersion medium (FIG. 1)).

9 Claims, 2 Drawing Figures

PROCESS FOR THE PRODUCTION OF DISPERSIONS AND PHOTOGRAPHIC MATERIALS

Figure 1:
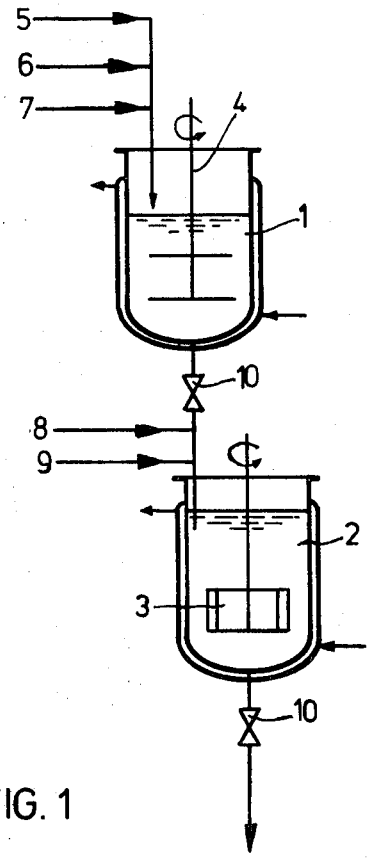

This invention relates to a process for the production of dispersions and to photographic materials containing such dispersions. More particularly, the present invention relates to the production of dispersions of organic, hydrophobic substances in an aqueous phase.

In the context of the present invention, "dispersions" are to be understood to be apparently homogeneous systems which contain at least two phases in finely dispersed form, the size of the particles of the phases being no larger than 1 nm. Examples of dispersions are, for example, emulsions and suspensions. The expression "emulsate" is also widely used in the photographic field.

It is known that dispersions of the type in question may be obtained by mixing organic substances, particularly colour couplers, in liquid or solid form, with high-boiling solvents of the type known as "oil-formers", optionally adding a low-boiling auxiliary solvent and dispersing the resulting mixture with an aqueous solution, generally a gelatin solution, using an emulsifier. Processes of this type are described in U.S. Pat. No. 2,322,027 and in British Pat. No. 791,353. In addition it is known from German Patent No. 1,143,707 that dye components melting below 75° C. may be emulsified in a gelatin solution heated to 90° C. by means of an emulsifier. It is known from British Pat. No. 1,151,590 that colour couplers melting at temperatures down to below 100° C. may be used, the colour couplers being mixed with a dispersant. It is known from East German Pat. No. 139,040 that colour couplers melting at temperatures above 75° C. may be used by mixing them with a high-boiling solvent and then emulsifying the resulting mixture in water containing a wetting agent. The resulting emulsion may then be mixed with a gelatin solution at low temperature.

It is known from British Pat. No. 636,102 which relates to the production of adhesive mixtures, that dispersions of the type in question may be obtained by the phase reversal or phase inversion of a water-in-oil emulsion into an oil-in-water emulsion at temperatures below 100° C. In the case of dispersions of this type, however, the criterion of particle fineness is obviously not as critically important as it is in the case of colour coupler dispersions intended to be used for photographic purposes. In addition, the stability of these dispersions is inadequate and is only achieved by using further additives.

In addition, it is known from German Offenlegungsschrift No. 3,011,927 that, by dissolving a colour coupler in a low-boiling solvent and the addition of water, it is possible to produce a water-in-oil emulsion which may be converted by means of phase reversal by the addition of more water into an oil-in-water emulsion. The resulting oil-in-water emulsion has to be stabilised by the addition of a binder.

One disadvantage of the known processes is that it is extremely difficult in a single operation to produce highly concentrated dispersions in a binder in fine phase dispersion without the assistance of low-boiling solvents.

An object of the present invention is to provide a dispersion process which avoids the disadvantages attending known processes. More particularly, an object of the present invention is to provide a dispersion process which enables the dispersed compounds to be finely dispersed in high concentrations in a binder without a need to use low-boiling solvents.

It has now been found that dispersions may be produced from at least one liquid organic phase containing a hydrophobic, photographically-active compound and at least one aqueous phase by a process in which both phases are combined and at the same time dispersed. According to the present invention, the organic phase is initially introduced and the aqueous phase is added thereto with dispersion until an oil-in-water emulsion is formed by phase reversal from the water-in-oil emulsion initially obtained. The viscosity passes through a maximum during the phase reversal process.

The organic phase preferably contains a substance which is substantially immiscible with water at pH 7, more particularly a photographically-active substance. In one preferred embodiment, a preferably high-boiling oil-former may additionally be present.

This inversion method or phase reversal method is described, for example, in the literature in Ullmann, Enzyklopadie der technischen Chemie, Vol. 10, page 454 and in Stache, Tensid-Taschenbuch, Hanser-Verlag 1979, pages 180 et seq. However, the use of the phase reversal method for producing dispersions containing photographically-active substances from oil-soluble photographic additives or the molten oil-soluble additive or a pure melt thereof in an aqueous binder solution containing active substances is not obvious to those skilled in the art because, in this phase reversal method, both phases have to be kept for prolonged periods under severe shearing at temperatures exceeded by the higher of the liquefaction temperatures of the two phases. For this reason, those skilled in the art have to assume from the generally accepted teaching that, under these circumstances, the structure of the binders is destroyed to the point where the binders are ineffectual by the combination of thermal and mechanical stressing.

The process according to the present invention is eminently suitable for the production of dispersions of organic, hydrophobic photographically-active substances in an aqueous medium. Examples of such substances are hydrophobic couplers of various types (4-equivalent couplers, 2-equivalent couplers, DIR-couplers, masking couplers, white couplers, competitive couplers), dyes or other dye-producing compounds, for example for the dye diffusion transfer process, UV absorbers, stabilisers and other photographic additives.

The aqueous phase preferably contains hydrophilic colloidal binders, for example gelatin, for improving the stability of the dispersions. The gelatin may also be completely or partly replaced by other natural, synthetic or semisynthetic binders, for example by derivatives of alginic acid or cellulose, by polyvinyl alcohol, polyacrylates, partially hydrolysed polyvinyl acetate or polyvinyl pyrrolidone.

Although the gelatin acts as a dispersion aid, it is not absolutely essential. Thus, a finely divided stock dispersion having a particle size of 320 nm, for example, may be produced without gelatin. For the same concentration of organic phase, the presence of gelatin in the aqueous phase provides for a finer particle size distribution. In addition, the concentration of organic phase required for phase reversal may be reduced with gelatin without an increase in particle size. In addition, the concentration of gelatin may be used for controlling particle size because the higher the concentration of gelatin, the smaller the size of the particles.

The dispersion temperature has little or no effect upon the fineness of dispersion. Somewhat finer particle size distributions are obtained at relatively low temperatures and hence with a relatively high viscosity of the organic phase. The preferred temperature for the organic phase is from 50° to 90° C. for dissolution temperatures of from 100° to 140° C. The aqueous phase is advantageously maintained at from 50° to 90° C.

Dispersion is carried out at normal pressure, although it may also be carried out under pressure should this be necessitated by relatively high temperatures, (for example, for products having relatively high liquefaction temperatures).

The average particle size in the dispersions obtained depends upon the residence time, the intensity of mixing and the dispersion temperature. In general, the effect of residence time decreases with increasing intensity of mixing.

In principle, it is possible to obtain various particle sizes, particle sizes of from 200 to 800 nm being preferred and those from 300 to 350 nm being particularly preferred.

According to the present invention, it is even possible to disperse relatively temperature-sensitive substances at high temperatures in the dispersion unit.

One of the considerable technical advances afforded by the process according to the present invention resides in the fact that it is possible to produce extremely fine, highly concentrated (up to 70%) dispersions, while in the conventional process experience with the various systems has shown that the fineness of dispersion is poorer, the higher the concentration of disperse phase. Because of this, conventionally-produced emulsions for photographic use barely contains 20% of disperse phase.

Another surprising technical advantage resides in the fact that the requisite fineness (normally from 100 to 500 nm) may be obtained using considerably simpler dispersion machines consuming considerably less energy.

The use of an oil-former (a high-boiling solvent, such as tricresyl phosphate or dibutyl phthalate) is not absolutely essential. Unless there are factors which dictate otherwise, it is advantageous to use only as much oil-former as is necessary for preparing a pumpable solution at the preferred dispersion temperature of from 50° to 90° C.

The ratio of organic substance (colour coupler UV absorber, etc.) to oil-former is not a critical factor to the success of the process. The oil-former (a high-boiling solvent) is not absolutely essential although it is advantageous not to exceed a viscosity of 1000 mPas at the preferred dispersion temperature. A corresponding viscosity adjustment is possible by the addition of an oil-former.

The oil-formers are substances which generally boil at temperatures above 180° C. and which have a good dissolving power for the hydrophobic substance to be dispersed. Of these substances, it is preferred to use the esters of glutaric acid, adipic acid, phthalic acid, sebacic acid, succinic acid, maleic acid, furmaric acid, isophthalic acid, terephthalic acid and phosphoric acid or the esters of glycerol and also paraffin and fluorinated paraffin because these compounds are chemically stable and are very easy to obtain and to handle and, when the dispersions are used for photographic purposes, do not have an adverse effect upon the photosensitive materials. According to the present invention, particularly preferred oil-formers are tricresyl phosphate, triphenyl phosphate, dibutyl phthalate, di-n-octyl phthalate, di-2-ethylhexyl phthalate, glycerol tributyrate, glycerol tripropionate, dioctyl sebacate, paraffin and fluorinated paraffin. Examples of the preferred oil-formers are given in the following:

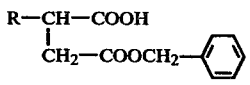
(1)

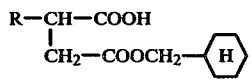
(2)

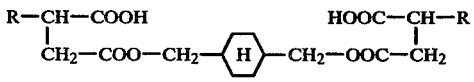
(3)

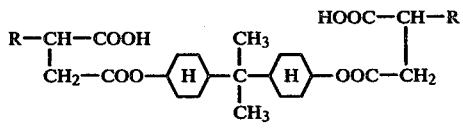
(4)

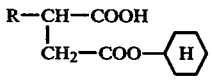
(5)

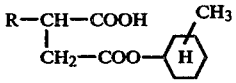
(6)

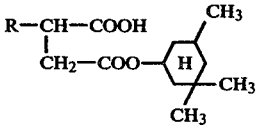
(7)

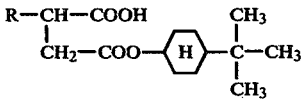
(8)

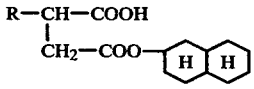
(9)

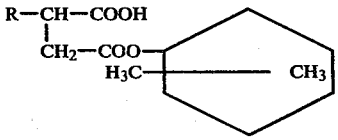
(10)

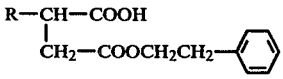
(11)

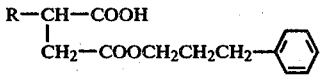
(12)

-continued

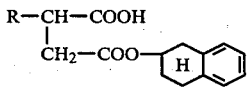
(13)

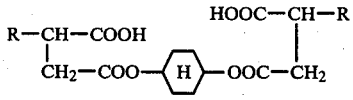
(14)

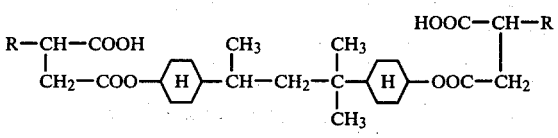
(15)

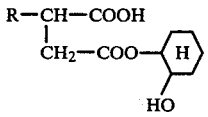
(16)

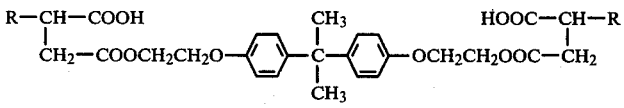
(17)

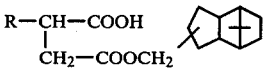
(18)

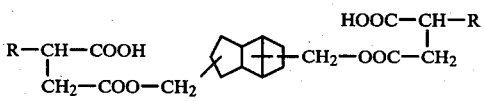
(19)

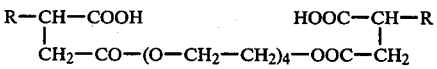
(20)

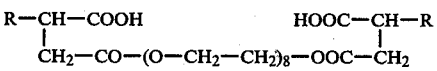
(21)

The binder containing dispersion may be further processed by conventional methods, for example it may be allowed to gel on cooling belts, converted into noodle form by passing it through a perforated plate and stored in cool cellars. In these process steps, too, the high concentration of the photographically-active disperse phase does of course bring about a corresponding increase in the volume/time yield and a reduction in the storage volume and cooling costs.

However, the highly concentrated dispersate obtained may also be diluted with aqueous binder-containing solution and/or a photographic emulsion containing silver halide without an increase or reduction in the size of the particles. In addition, it has surprisingly been found that the dispersions in question may be converted into dry emulsates characterised by high storage stability, high solubility and good re-dispersibility, for example by one of the dry processes normally used for gelatin, by a belt drying technique, for example by a process of the type described in U.S. Pat. No. 2,801,171, particularly when the concentration of the hydrophilic binder amounts to from 10 to 25%, based on an aqueous phase. The economic advantage of such dry, highly concentrated and, hence, substantially water-free emulsates is obvious.

The apparatus used for carrying out the process according to the present invention are stirrer-equipped vessels of the type commonly used in chemical factories. Accompanying FIG. 1 shows one suitable apparatus comprising a stirrer-equipped vessel 1 in which a solution of gelatin, water and emulsifier is prepared. A solution of colour coupler and oil-former is prepared at from 100° to 140° C. in a stirrer-equipped vessel 2. This stirrer-equipped vessel 2 is simultaneously serves as the receiving vessel and is equipped with a Kotthoff mixing horn 3. The vessel 1 is equipped with a stirrer 4. Gelatin, water and emulsifier may be introduced into the vessel 1 through the feed pipes 5, 6 and 7, respectively. Oil-former and coupler may be introduced into the vessel 2 through the feed pipes 8 and 9, respectively. Inflow and outflow may be regulated through the valves 10. After the gelatin solution has been added and phase reversal completed, the emulsate may be run off for the particular application intended, in some cases advantageously through a downstream high-pressure homogenising machine, although this is not absolutely essential in every case.

Figure 2:
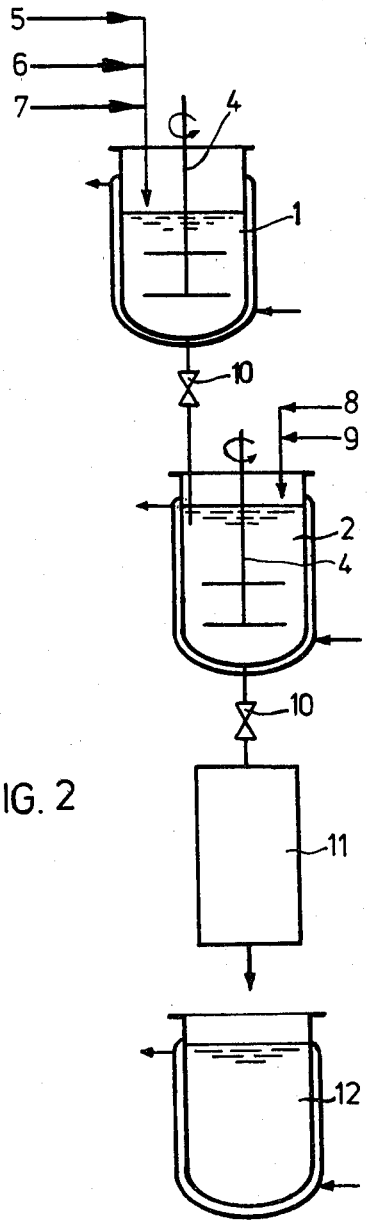

Particularly fine dispersions are obtained when phase reversal is displaced into the shearing zone. This may be accomplished as illustrated in accompanying FIG. 2. The aqueous phase of water 5, gelatin 6 and emulsifier 7 is prepared in a vessel 1 equipped with a stirrer 4. The organic phase of oil-former 8 and colour coupler 9 is introduced into a vessel 2 equipped with a stirrer 4. A water-in-oil emulsion is prepared by adding the solution from 1 to 2. This water-in-oil emulsion is converted by the application of corresponding shearing forces in a dispersion machine 11 into an oil-in-water emulsion which is available for further use in a vessel 12.

The dispersions prepared in accordance with the present invention are eminently suitable for the production of photosensitive photographic materials containing silver halide. The dispersions may be introduced in known manner into materials of this type. The dispersions may be introduced both into layers containing silver halide and also into layers free from silver halide.

It is possible to use the conventional silver halide emulsions which may be prepared by the conventional known methods. Gelatin may be used as binder for the photographic layers, although it may be completely or partly replaced by other binders. Stabilisers, such as triazole derivatives, thiocarbonic acid derivatives of thiadiazole or azaindenes, may be added to the emulsions as anti-fogging agents. The silver halide emulsions may be additionally sensitised using the conventional chemical sensitisers. Optical sensitisation may be carried out using the conventional sensitisers described, for example in F. M. Hamer's book entitled "The Cyanine Dyes and Related Compounds" (1964), Interscience Publishers John Wiley & Sons.

Hardening of the photographic layers is carried out under conditions which do not have any adverse effect upon the tone of the image, but which enable the layers to be processed at high speed, even at elevated temperatures. Suitable hardening agents are, for example, formalin, dialdehydes, divinyl sulphone, triazine derivatives, optionally in the presence of tertiary amines, also instant hardeners, such as carbamoyl pyridinium compounds or carbodiimides. It is possible to use the conventional layer supports, for example polyolefin-coated supports, for example polyethylene-coated paper, suitable polyolefins and paper, also polyester supports and triacetate-based films.

EXAMPLE 1

520 kg of a 10% gelatin solution are introduced into the vessel 1 shown in accompanying FIG. 1. 22.5 kg of triisopropyl naphthalene sulphonate are additionally dissolved in this solution at a temperature of 60° C. (aqueous phase, W).

In a second vessel (2), 350 kg of a coupler corresponding to the following formula:

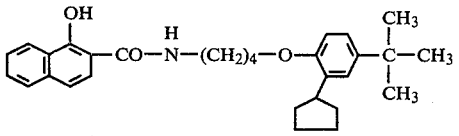

150 kg of a coupler corresponding to the following formula:

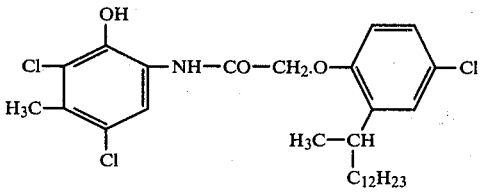

and 400 kg of tricresyl phosphate are dissolved at 140° C., followed by cooling to 80° C. (oil phase, 0).

The contents of the first vessel are run into the second vessel with continuous mixing using a turbine impeller 3 of the Kotthoff mixing horn type operated in the second vessel. A water-in-oil (W/O) dispersion is initially formed, changing into an oil-in-water (O/W) dispersion by phase reversal by the time the addition of the aqueous phase is over.

The average size of the particles in the dispersion amounts to 350 nm. A 35% dispersion is obtained.

EXAMPLE 1a 67 kg of the colour coupler dispersion produced in accordance with Example 1 are added to 1000 kg of a molten photographic silver halide emulsion tempered to 40° C. which has been provided in the conventional way with an optical sensitiser for the red spectral region and with further additives designed to influence its stability. This emulsion is cast to form a photographic layer following the addition of hardeners and the wetting agents normally used for casting.

EXAMPLE 1b

The concentrated colour coupler dispersion prepared in accordance with Example 1 is blended at 40° C. with 520 kg of a 25% gelatin solution. The emulsate formed is dried by known methods (cf. U.S. Pat. No. 2,801,171).

EXAMPLE 1c 1200 kg of a solution of 120 kg of gelatin and 4.8 kg of phenol in 1075.2 kg of water are added at 40° C. to the concentrated colour coupler dispersion prepared in accordance with Example 1, followed by conversion into gel form by cooling to 4° C. After storage pending use, the gel is dissolved at 40° C. in 2680 kg of a solution of 78 kg of gelatin and 10.8 kg of phenol in 2591.2 kg of water.

EXAMPLE 1d 3879.5 kg of a solution of 198 kg of gelatin and 12.5 kg of phenol in 3669 kg of water are added at 40° C. to the concentrated colour coupler dispersion prepared in accordance with Example 1. The solution may then be further processed directly by addition to a photographic silver halide emulsion or may be converted by cooling into gel form and stored pending use.

EXAMPLE 2

268.1 kg of a 10% gelatin solution prepared in known manner are introduced at 60° C. into the dissolving vessel 1 shown in accompanying FIG. 1, followed by the introduction of 9.3254 kg of an emulsifier (75%) of the straight-chain alkyl benzene sulphonate type (aqueous phase).

In a second vessel 2, 105 kg of dibutyl phthalate and 35 kg of a compound corresponding to the following formula:

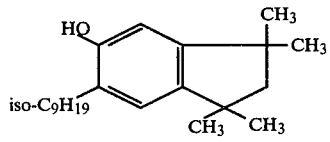

are heated to 140° C., after which 70 kg of a coupler corresponding to the following formula:

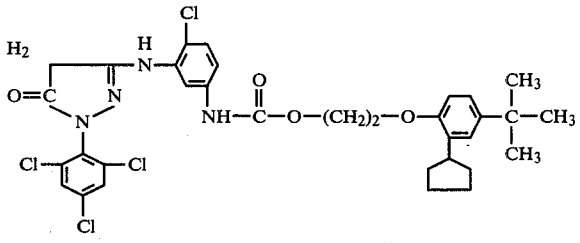

are stirred in. After a clear solution has formed, it is cooled to 80° C. and the contents of vessel 1 are added to the contents of vessel 2 (organic phase).

An oil-in-water dispersion is formed from the initial water-in-oil dispersion and is recirculated for 30 minutes at 3000 l/h under a pressure of 200 bars using a Knollenberg high-pressure homogeniser.

The average particle size amounts to 310 nm. A 14% dispersion is obtained.

EXAMPLE 2a

The concentrated colour coupler dispersion prepared in accordance with Example 2 is mixed with the corresponding quantity of a silver halide emulsion to form the photographic emulsion ready for casting and the resulting emulsion is cast after addition of the conventional additives.

EXAMPLE 2b

The concentrated colour coupler dispersion prepared in accordance with Example 2 is blended at 40° C. with 324 kg of a 25% gelatin solution. The emulsate formed is dried by known methods.

EXAMPLE 2c

During the emulsification process, a solution of 809.9 kg of a 10% gelatin solution, 541.8 kg of water and 2.8 kg of a 50% phenol solution is introduced at 40° C. into the vessel 1. The resulting concentrated stock emulsion in which the particles have the final fineness required, is introduced under pressure into the vessel 1 by means of a reciprocating piston pump and a high-pressure homogeniser, diluted to the final concentration and run off again through the vessel 2 and the homogenising circuit which, at the same time, is roughly cleaned.

The emulsion is converted into gel form by cooling to 4° C. and stored at 10° C. pending use.

EXAMPLE 3a

A colour coupler melt of 350 g of a coupler corresponding to the following formula:

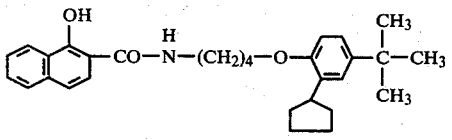

150 g of a coupler corresponding to the following formula:

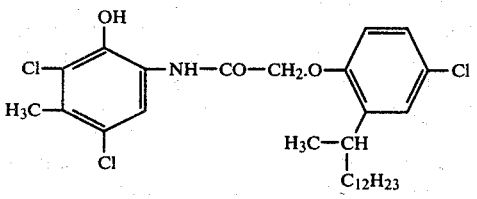

and 400 g of tricresyl phosphate is prepared at 140° C. in a stirrable and heatable vessel, followed by cooling to 60° C. A solution, heated to 60° C., of 300 g of water and 22.5 g of triisopropyl naphthalene sulphonate is then added to the resulting solution over a period of 2 minutes. A water-in-oil dispersion is initially formed, subsequently changing by phase reversal into an oil-in-water dispersion. The emulsion is homogenised for 15 minutes under a pressure of from 150 to 200 bars using a high-pressure homogeniser of the Gau-type. A 74% dispersion having a particle size of 310 nm is obtained.

EXAMPLE 3b

An organic phase is prepared in the same way as in Example 3a.

A solution, heated to 60° C. of 250 g of a 10% gelatin solution and 22.5 g of triisopropyl naphthalene sulphonate is introduced into this solution over a period of 2 minutes at 60° C. A water-in-oil dispersion is initially formed, subsequently changing by phase reversal into an oil-in-water dispersion. The emulsion is homogenised for 15 minutes under a pressure of from 150 to 200 bars using a high pressure homogeniser of the Gau-type. A dispersion having a particle size of 270 nm is obtained.

EXAMPLE 4

A colour coupler melt of 0.75 kg of dibutyl phthalate, 0.05 g of a coupler corresponding to the following formula:

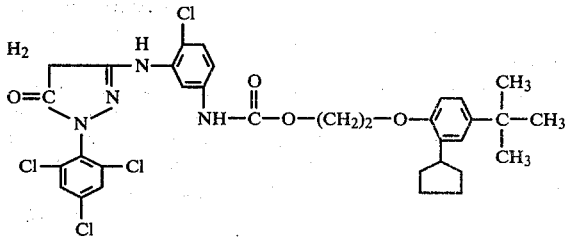

and 0.25 kg of a compound corresponding to the following formula:

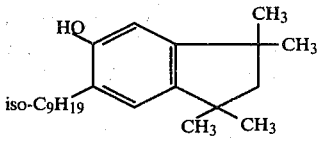

is dissolved at 120° C. and introduced into a heatable and stirrable 10 liter pressure vessel. A disc stirrer 60 mm in diameter and rotating at a frequency of 1000 $min^{-1}$ is used as the stirrer. A mixture heated to 95° C. of 2.0 kg of a 10% gelatin solution and 0.07 kg of triisopropyl naphthalene sulphonate is introduced at 20 kg/h into this vessel from a heated and stirred, open receiver by means of a gear metering pump.

An O/W dispersion is formed from an initial W/O-dispersion at a temperature of 120° C. and under an excess pressure of 1 bar and is subsequently stirred for 20 minutes under these conditions. It is then cooled to 60° C., vented and run into storage vessels or further processed directly.

A finely divided dispersion having an average particle size of 550 nm and a concentration of 14% is formed.

EXAMPLE 5

900 g of 10% gelatin and 66 g of a straight-chain alkyl benzene sulphonate (75%) are introduced at 60° C. into the dissolution vessel 1 shown in accompanying FIG. 1.

In a second vessel, 300 g of tricresyl phosphate are heated to 140° C., after which 300 g of 1-(2',4',6'-trichlorophenyl)-3-(3''-γ-[2''',4'''-di-t-amylphenoxy]-butyramido)-benzamido-5-pyrazolone and 300 g of 1-(2',4',6'-trichlorophenyl)-3-[2''-chloro-5''-cetyloxycarbonylamido)-anilino]-5-pyrazolone are stirred in and dissolved.

After a clear solution has formed, it is cooled to 80° C., the contents of vessel 1 are added with stirring to the contents of vessel 2, followed by recirculation for 12 minutes under a pressure of from 200 to 250 bars using a high-pressure homogeniser 3 of the Manton Gaulin type. The dispersion formed has an average particle size of 350 nm and a concentration of 38%.

The resulting finely divided concentrated dispersion is then run into another tempered stirrer-equipped vessel containing a mixture, heated to 40° C. of 3600 g of a 10% gelatin solution, 1350 g of $H_2O$ and 112.5 g of a 20% phenol solution.

The resulting emulsate is then allowed to gel on a cooling belt and stored at +10° C. pending further processing.

The dispersate obtained is added in known manner to a silver halide emulsion containing 60 g/l of silver halide. The resulting dispersion is provided with hardening and wetting agents and cast onto a substrate in known manner. The material obtained is exposed to form an image and developed in a conventional colour developer.

For comparison, a corresponding photographic material is prepared from the same silver halide emulsion containing the same dispersed compounds, the only difference being that dispersion is carried out as follows and not in accordance with the present invention.

The above-indicated quantities of coupler and tricresyl phosphate are dissolved in 1200 g of ethyl acetate. A mixture is prepared by running the resulting solution, with stirring, into 4500 g of a 10% gelatin solution which has been provided with the above-indicated quantity of wetting agent. The resulting mixture is repeatedly passed through a mixing horn and dispersed. The solvent is then evaporated off in vacuo. The emulsate obtained is added to the silver halide emulsion.

The comparison material was processed in the same way as the material according to the present invention.

The sensitometric data set out in the following Table show that greater sensitivity, gradation and maximal density are obtained in accordance with the present invention.

| | Gradation | Sensitivity | $D_{max}$ |
|---|---|---|---|
| Invention | 1.14 | 4.22 | 2.33 |
| Comparison | 1.03 | 4.17 | 2.17 |

An increase in sensitivity and 0.3010 units corresponds to a doubling of sensitivity.

EXAMPLE 6a 15 kg of the compounds according to German Offenlegungsschrift No. 2,036,719 and 15 kg of the compound according to German Offenlegungsschrift No. 1,772,192 are prepared by heating to 80° C. in a dissolution vessel.

40 kg of a 12% gelatin solution and 0.628 kg of emulsifier of the straight-chain alkyl benzene sulphonate type (10%) are added to the resulting organic phase. The addition is made with stirring using a mixer turning at a peripheral speed of 5 m/s. The water-in-oil emulsion produced in the first instance is converted by phase reversal into the resulting oil-in-water emulsion. The dispersion has a particle size of 572 nm.

EXAMPLE 6b

An organic phase is prepared in the same way as in Example 6a, except that 1.884 g of emulsifier are used with 12% gelatin solution. The resulting dispersion has a particle size of 475 nm.

EXAMPLE 6c

An organic phase is prepared in the same way as in Example 6a, except that a 20% gelatin solution and 1.884 kg of emulsifier are used. The resulting dispersion has a particle size of 404 nm.

EXAMPLE 6d

An organic phase is prepared in the same way as in Example 6a. A 20% gelatin solution and 1.884 kg of emulsifier are used. On this occasion, however, phase reversal takes place at peripheral speeds of 23 m/s. The resulting dispersion has a particle size of 385 nm.

We claim:

1. In the process for the production of a dispersion of at least one liquid organic phase containing a hydrophobic,
   photographically-active substance and at least one liquid aqueous phase,
   by combining the phases by dispersion in a dispersion unit,
   first, providing in the dispersion unit at least one liquid organic phase containing a hydrophobic photographically-active compound and,
   then adding an aqueous phase, in which a binder is dissolved, to the organic phase and dispersing to obtain a dispersion of the aqueous phase in the organic phase,
   carrying out the dispersion at a temperature above the liquefaction temperatures of the two phases
   and until the viscosity passes through a maximum and
   a dispersion of the organic phase in the aqueous phase is obtained.

2. A process as claimed in claim 1, characterised in that the organic phase is the pure melt of a photographically-active substance and in that dispersion is carried out above the liquefaction temperature of the photographically-active substance.

3. A process as claimed in claim 1, characterised in that the organic phase is the solution of a photographically-active substance in an oil-former (a high-boiling solvent) and in that dispersion is carried out above the liquefaction temperature of that solution.

4. A process as claimed in claim 1, characterised in that the aqueous phase contains dissolved binders and in that dispersion is carried out above the liquefaction temperature of this binder solution.

5. A process as claimed in claim 1, characterised in that the aqueous phase is a gelatin solution.

6. A process as claimed in claim 1, characterised in that the photographically-active substance is a colour coupler.

7. A process as claimed in claim 1, characterised in that the photographically-active substance is a UV-absorber.

8. A process as claimed in claim 1, characterised in that the photographically-active substance is a stabiliser.

9. A photographic material consisting of a layer support, at least one silver halide emulsion layer and, optionally, further layers, characterised in that at least one of the layers contains in finely dispersed form a dispersion of organic, hydrophobic photographically-active substances in an aqueous medium produced by first providing a liquid organic phase containing a hydrophobic photographically-active compound and combining an aqueous phase with the organic phase by dispersing and in which the aqueous phase is dispersed in the organic phase and then effecting a phase reversal at a temperature above the liquefaction temperatures of the two phases until the viscosity passes through a maximum, said dispersion of the organic phase in the aqueous phase being characterised by homogenity of the systems.

* * * * *